US011146018B2

(12) United States Patent
Koellmann

(10) Patent No.: US 11,146,018 B2
(45) Date of Patent: Oct. 12, 2021

(54) CONDUCTOR CONNECTION TERMINAL

(71) Applicant: WAGO Verwaltungsgesellschaft mbH, Minden (DE)

(72) Inventor: Hans-Josef Koellmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 17/018,660

(22) Filed: Sep. 11, 2020

(65) Prior Publication Data

US 2021/0075144 A1 Mar. 11, 2021

(30) Foreign Application Priority Data

Sep. 11, 2019 (DE) ..... 20 2019 105 009.8

(51) Int. Cl.

| | |
|---|---|
| ***H01R 4/24*** | (2018.01) |
| ***H01R 13/508*** | (2006.01) |
| ***H01R 13/58*** | (2006.01) |
| ***H01R 13/629*** | (2006.01) |

(52) U.S. Cl.

CPC ..... *H01R 13/508* (2013.01); *H01R 13/5829* (2013.01); *H01R 13/62961* (2013.01)

(58) Field of Classification Search

CPC ..... H01R 12/79; H01R 2/78; H01R 12/592; H01R 9/0757; H01R 13/193; H01R 23/7068; H01R 43/24; H01R 4/4818; H01R 4/4827; H01R 4/4845; H01R 4/4836; H01R 13/428; H01R 13/11; H01R 13/426; H01R 13/50

USPC ..... 439/495, 342, 496, 493, 632, 606, 405, 439/492, 499, 441, 835, 729

See application file for complete search history.

(56) References Cited

U.S. PATENT DOCUMENTS

| | | | |
|---|---|---|---|
| 8,794,994 | B2 | 8/2014 | Köllmann et al. |
| 9,124,034 | B2 | 9/2015 | Köllmann et al. |
| 9,502,790 | B2 | 11/2016 | Köllmann et al. |
| 9,525,219 | B2 | 12/2016 | Köllmann et al. |
| 9,543,700 | B2 | 1/2017 | Köllmann et al. |

(Continued)

FOREIGN PATENT DOCUMENTS

| | | |
|---|---|---|
| DE | 20 2013 100 635 U1 | 4/2013 |
| DE | 10 2011 056 410 A1 | 6/2013 |

(Continued)

*Primary Examiner* — Phuong Chi Thi Nguyen

(74) *Attorney, Agent, or Firm* — Muncy, Geissler, Olds & Lowe, P.C.

(57) ABSTRACT

A conductor connection terminal with at least one spring-loaded clamping connection for connecting an electrical conductor, wherein the conductor connection terminal has at least one housing with a conductor insertion opening for inserting the electrical conductor to be connected, a busbar, a clamping spring with a clamping arm for clamping the electrical conductor to the busbar in a contact area on the busbar, and a pivotable actuation element for actuating the clamping spring, wherein the actuation element has at least one actuation handle for a manual actuation and at least one bearing plate which is connected to the actuation handle and via which the actuation element is rotatably mounted on at least one component of the conductor connection terminal, wherein the actuation handle is accessible from the outside on an actuation side of the housing.

16 Claims, 3 Drawing Sheets

(56) References Cited

U.S. PATENT DOCUMENTS

| | | | | |
|---|---|---|---|---|
| 9,825,402 | B2 | 11/2017 | Köllmann et al. | |
| 2018/0331438 | A1* | 11/2018 | Moser | H01R 4/4836 |

FOREIGN PATENT DOCUMENTS

| | | |
|---|---|---|
| DE | 10 2013 101 406 A1 | 8/2014 |
| DE | 10 2013 101 410 A1 | 8/2014 |
| DE | 10 2015 104 625 A1 | 9/2016 |
| DE | 10 2016 118 331 A1 | 3/2018 |

* cited by examiner

CONDUCTOR CONNECTION TERMINAL

This nonprovisional application claims priority under 35 U.S.C. § 119(a) to German Patent Application No. 20 2019 105 009.8, which was filed in Germany on Sep. 11, 2019, and which is herein incorporated by reference.

BACKGROUND OF THE INVENTION

Field of the Invention

The present invention relates to a conductor connection terminal with at least one spring-loaded clamping connection for connecting an electrical conductor, wherein the conductor connection terminal has at least one housing with a conductor insertion opening for inserting the electrical conductor to be connected, a busbar, a clamping spring with a clamping arm for clamping the electrical conductor to the busbar in a contact area on the busbar, and a pivotable actuation element for actuating the clamping spring, wherein the actuation element has at least one actuation handle for a manual actuation and at least one bearing plate which is connected to the actuation handle and via which the actuation element is rotatably mounted on at least one component of the conductor connection terminal, wherein the actuation handle is accessible from the outside on an actuation side of the housing.

Description of the Background Art

A conductor connection terminal is known, e.g., from DE 20 2013 100 635 U1, which corresponds to U.S. Pat. No. 9,502,790, which is incorporated herein by reference.

SUMMARY OF THE INVENTION

It is therefore an object of the present invention to provide a conductor connection terminal that is further improved in comparison.

The object is achieved in the case of a conductor connection terminal of the aforementioned type in that the bearing plate has a circular area and the contact area of the busbar, viewed transversely to a conductor insertion direction, is located within the circular area of the bearing plates. The bearing plate is therefore comparatively high in the height direction. The bearing plate can be formed, for example, circular over part of its circumference or its entire circumference. In this case, the bearing plate has a relatively large diameter compared with known solutions. This has the advantage that the conductor connection terminal can be realized with a relatively small lever opening through which the actuation handle on the actuation side is guided outwards through the housing. The lever opening is thus located on the actuation side of the housing.

In addition, improved clearance and creepage distances can be realized with little effort. The housing can be designed, e.g., as an insulating material housing.

The conductor connection terminal can be designed, e.g., such that the bearing plate extends at least from the bottom side of the conductor insertion opening to the top side of the conductor insertion opening and/or extends at least from a position below the busbar to a position above the clamping spring, in particular above the contact arm of the clamping spring, in the height direction of the conductor connection terminal, which extends perpendicular to the actuation side.

The bearing plate can also extend in the height direction over the entire height of the housing, i.e., from an upper housing wall to a lower housing wall.

As mentioned, the actuation handle is accessible from a position outside the housing. The actuation handle can, for example, protrude from the housing, at least in certain actuation positions of the actuation element. The actuation element can have an open position and a closed position. In the open position, the clamping spring or its clamping arm is actuated by the actuation element and is deflected with respect to the closed position. In the closed position, the clamping spring or the clamping arm is not deflected by the actuation element, so that the clamping arm bears against either a connected electrical conductor or the busbar.

The contact area of the busbar can be disposed between the circular areas of two bearing plates, e.g., a pair of bearing plates. As a result, the contact area of the busbar is covered on both sides by the bearing plates.

The housing can be designed as an at least two-part block housing which is made up of at least one first housing block and a second housing block, wherein abutting side walls of the first and second housing block abut one another at an abutting edge. As a result, an easily mountable and robust housing construction can be realized. The conductor connection terminal can in particular be formed as a multipole conductor connection terminal in which multiple spring-loaded clamping connections with a busbar, a clamping spring, and an actuation element are present next to one another in the housing, e.g., in separate housing chambers. The housing chambers can be separated from one another by side walls or by partition walls. In this case, the abutting edge can be present in particular on interior partition walls by which the housing chambers are separated from one another.

The abutting edge can be disposed within a housing region, which is overlapped by the bearing plate. In this way, the bearing plate brings about an increase in the clearance and creepage distances. The bearing plate thus acts as an additional partition between the adjacent spring-loaded clamping connections.

The abutting edge can be disposed in the area of the axis of rotation of the bearing plate. Accordingly, the bearing plate largely overlaps the abutting edge, which is also favorable for improving the clearance and creepage distances. The abutting edge can, e.g., be arranged at a distance of less than 50% of the diameter of the bearing plate from the axis of rotation of the bearing plate.

The bearing plate can have a partially circular outer contour with which the actuation element is rotatably mounted on at least one component of the conductor connection terminal. A uniform arcuate pivoting movement of the actuation element is made possible by the partially circular outer contour, which leads to a haptically pleasant actuation.

The bearing plate can be rotatably mounted on the housing and/or on the busbar. The housing and/or the busbar thus form a counter bearing for the bearing plate. For example, a bearing contour can be present in the housing and is designed as a counterpart to a bearing contour of the bearing plate, for example, as a counterpart to the partially circular outer contour of the bearing plate. Accordingly, there is no need to design other parts of the conductor connection terminal accordingly, so that they can be used as counter bearings for the bearing plate. For example, the clamping spring and the busbar can thus extend laterally past the bearing plate or, in the case of two parallel, spaced-apart bearing plates, extend between these bearing plates.

The actuation element can have a further bearing plate which is connected to the actuation handle and via which the actuation element is rotatably mounted on at least one component of the conductor connection terminal, wherein the bearing plates are spaced from one another and are arranged parallel to one another. In this way, the actuation element can be mounted in an improved manner and in particular symmetrically in the conductor connection terminal. Because the bearing plates are spaced from one another, there is a free space between the bearing plates through which space, as mentioned, for example, the clamping spring and/or the busbar can be fed. In addition, this free space can serve as a conductor receiving chamber or at least as part of the conductor receiving chamber. In this way, the electrical conductor to be connected can be conveniently accommodated in the conductor connection terminal.

The features mentioned with regard to the bearing plate can also be realized completely or partially for the further bearing plate.

The actuation element can have a follower which is designed to move the clamping arm of the clamping spring when the actuation element moves from a closed position to an open position and vice versa. This allows a favorable force transmission of an actuation force from the actuation handle to the clamping arm.

The follower can protrude laterally from the at least one bearing plate or, in the case of two bearing plates, extends from the one bearing plate to the other bearing plate. In the case of two bearing plates, the follower can also be designed in the form of two follower stubs, wherein a follower stub in each case protrudes from a bearing plate in the direction of the respective other bearing plate. In this way, a compact design of the entire conductor connection terminal can be furthered.

The follower can have a predominantly oval or predominantly kidney-shaped or predominantly elliptical cross-sectional shape. In particular, the follower can have an elongated, narrow cross-sectional shape, which in the closed position of the actuation element extends in the longitudinal direction at least approximately parallel to a conductor insertion direction of an electrical conductor into the conductor connection terminal. In this way, the follower can be disposed in a space-saving manner and does not interfere with the insertion of an electrical conductor into the conductor connection terminal.

The clamping spring can have the clamping arm, a spring bend, and a contact arm, wherein the contact arm is connected to the clamping arm via the spring bend.

The contact arm and the clamping arm can run substantially parallel, at least in an area protruding from the spring bend, when the actuation element is in the closed position and no electrical conductor is clamped. This allows the realization of particularly advantageous embodiments of conductor connection terminals, for example, conductor connection terminals with spring-loaded clamping connections in direct plug-in technology. Direct plug-in technology means that an electrical conductor, if it is sufficiently rigid, can be inserted directly into the clamping point and fixedly clamped there without actuating the clamping spring. The clamping spring then has to be actuated by means of the tension element only to release the electrical conductor.

The clamping arm can extend from the spring bend, initially predominantly parallel to the actuation side, and, in the further course, obliquely away from the actuation side. This also promotes the direct plug-in technology.

The conductor connection terminal can be designed, e.g., as an electrical plug connector which has one or more electrical plug contacts. The electrical plug contacts can then be contacted with electrical conductors via the respective spring-loaded clamping connection. If the housing is designed as an at least two-part block housing, the first housing block, for example, can essentially accommodate the parts of the spring-loaded clamping connection, i.e., the busbar, the clamping spring, and the actuation element. The second housing block can essentially accommodate the plug contact or plug contacts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
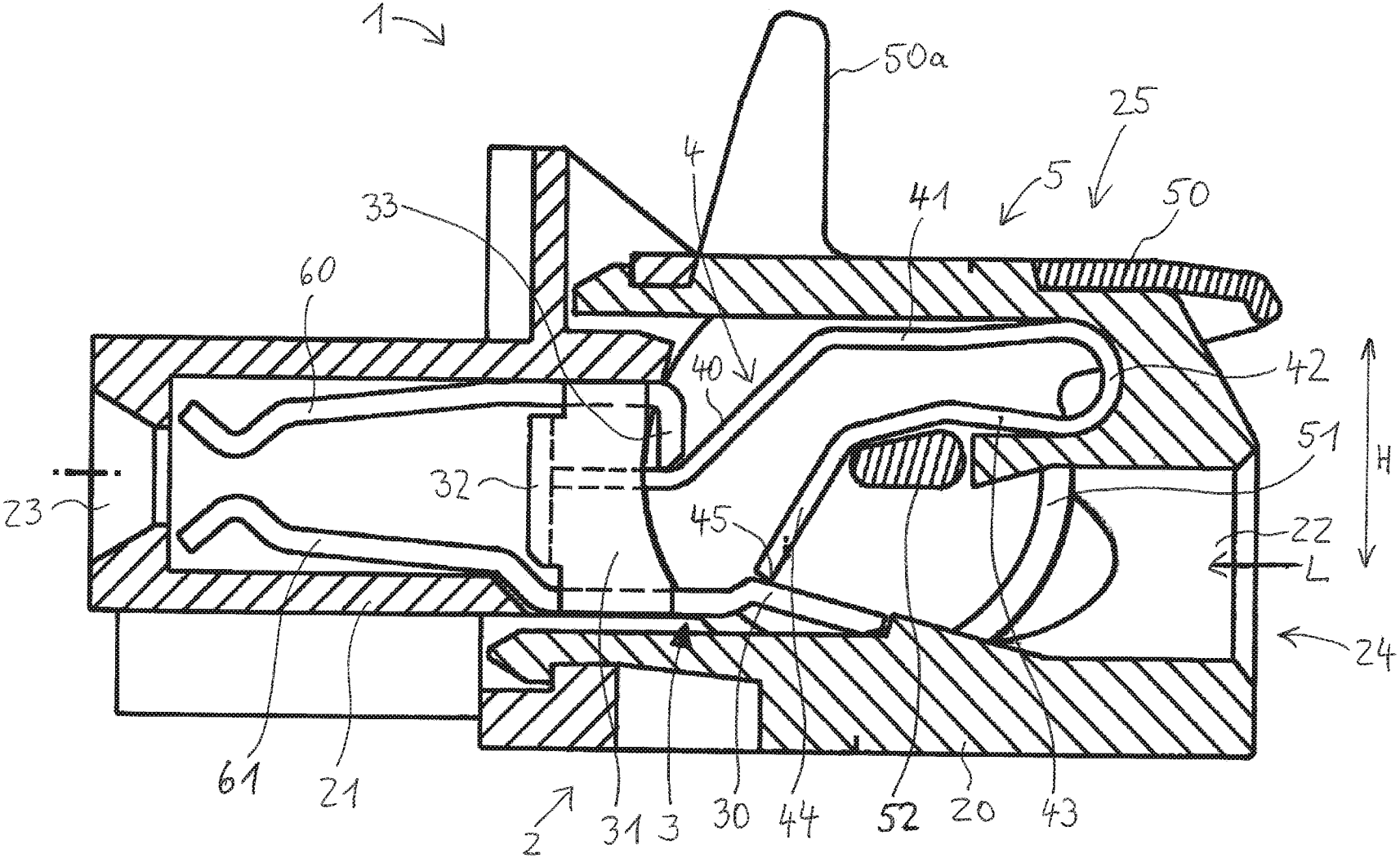
FIG. 1 shows a conductor connection terminal in a side cross-sectional view.

FIG. 1 shows a conductor connection terminal 1 with a housing 2. Housing 2 is designed as a two-part block housing with a first housing block 20 and a second housing block 21. Conductor connection terminal 1 is designed as a plug connector. Parts of an electrical plug connector 60, 61, e.g., fork tongues of a bifurcated contact, are therefore placed in second housing block 21. Electrical plug connector 60, 61 is accessible through a plug opening 23, which is present in second housing block 21, for contacting by a mating plug connector.

In first housing block 20 there is a spring-loaded clamping connection for connecting an electrical conductor. The spring-loaded clamping connection has a busbar 3, a clamping spring 4, and a pivotable actuation element 5, e.g., an actuation lever.

Housing 2 has a conductor insertion side 24 at which an electrical conductor can be inserted through a conductor insertion opening 22 in the conductor insertion direction L into conductor connection terminal 1 and can be fixedly clamped at a clamping point. Housing 2 also has an actuation side 25 at which actuation element 5 is accessible from the outside.

Clamping spring 4 has a contact arm 41, a spring bend 42 adjoining contact arm 41, and a clamping arm 43 adjoining spring bend 42. Clamping arm 43 merges into a clamping tongue 44 which is angled with respect to the base region of clamping arm 43, said region protruding from spring bend 42. Clamping tongue 44 ends at the free end with a clamping edge 45. Contact arm 41 has a lengthened area, which is designed as a fastening region 40 of contact arm 41 and is designed for fastening contact arm 41 to at least one part of conductor connection terminal 1, e.g., to a part of busbar 3. In this exemplary embodiment, fastening region 40 is angled obliquely in the direction of busbar 3 and, in a deflected state of clamping arm 43, forms a guide slope for an electrical conductor to be inserted.

Busbar 3 has a clamping section 30, a connecting section 31, a conductor stop 32, and a fixing section 33. Clamping section 30 is used to clamp an electrical conductor. The electrical conductor is then fixedly clamped at a clamping point between clamping section 30 and clamping arm 43, more precisely clamping tongue 44 and its clamping edge 45. Connecting section 31 adjoins clamping section 30 and runs substantially at right angles to clamping section 30, i.e., in the direction of the height direction H of conductor connection terminal 1. Conductor stop 32 branches off from connecting section 31. Conductor stop 32 is bent substantially at right angles with respect to connecting section 31, so that its normal direction extends parallel to the conductor insertion direction L of conductor connection terminal 1. In the upper area, connecting section 31 merges into fixing section 33, which is also angled again substantially at right angles with respect to connecting section 31. Clamping spring 4 is fastened to this fixing section 33 via fastening region 40. In this way, clamping spring 4 is supported on fixing section 33 with respect to the clamping force exerted by clamping arm 43.

Conductor stop 32 serves to limit the insertion depth of an electrical conductor into conductor connection terminal 1. Conductor stop 32 also ensures a separation between the conductor receiving area near the clamping point and the plug-in area, i.e., the area in which plug connector element 60, 61 is located.

The parts of plug connector 60, 61 also branch off from connecting section 31; i.e., plug connector 60, 61 can be designed in one piece with busbar 3.

Figure 2:
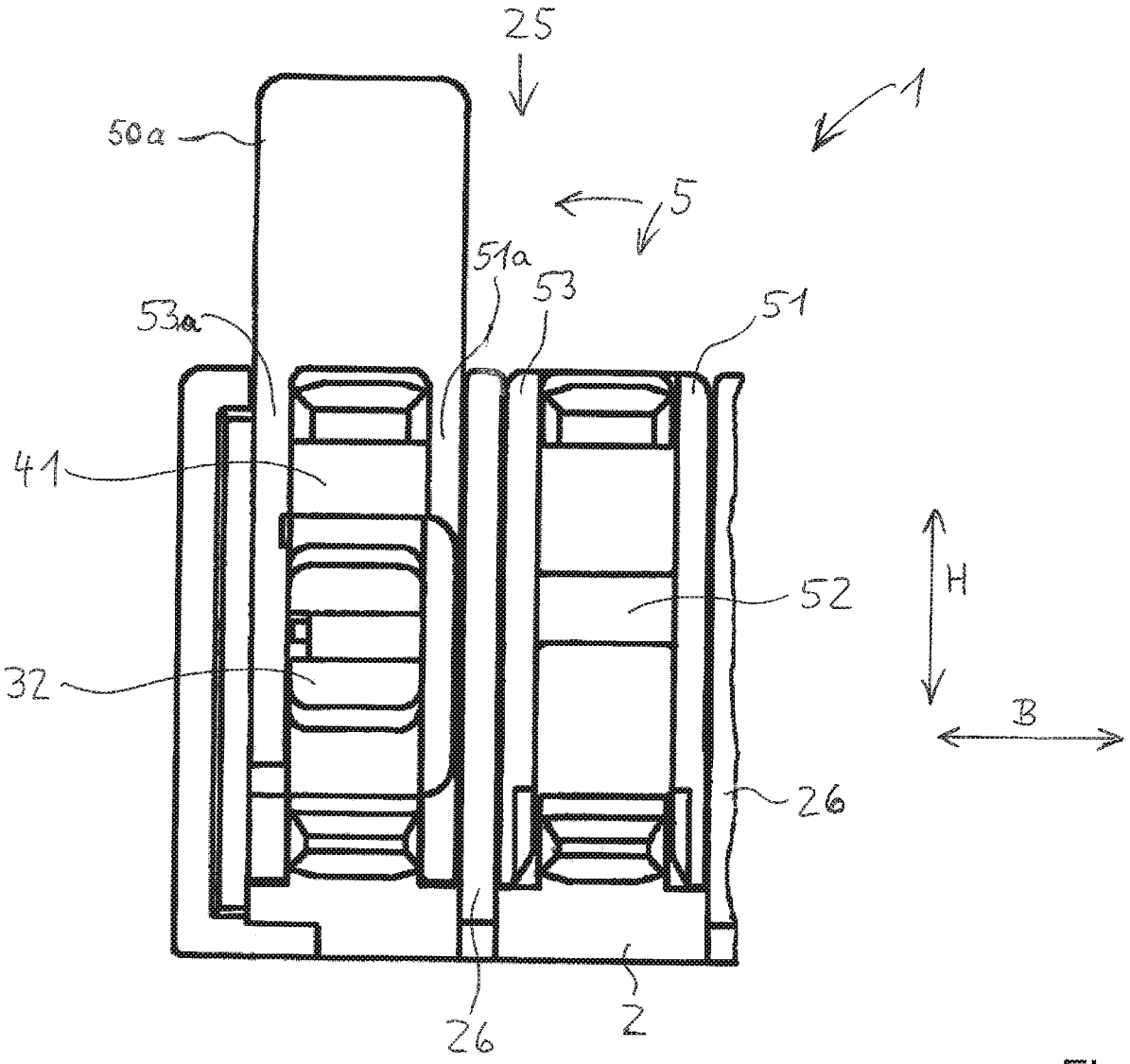
FIG. 2 shows the conductor connection terminal according to FIG. 1 in a plan view of a conductor insertion side.
Figure 3:
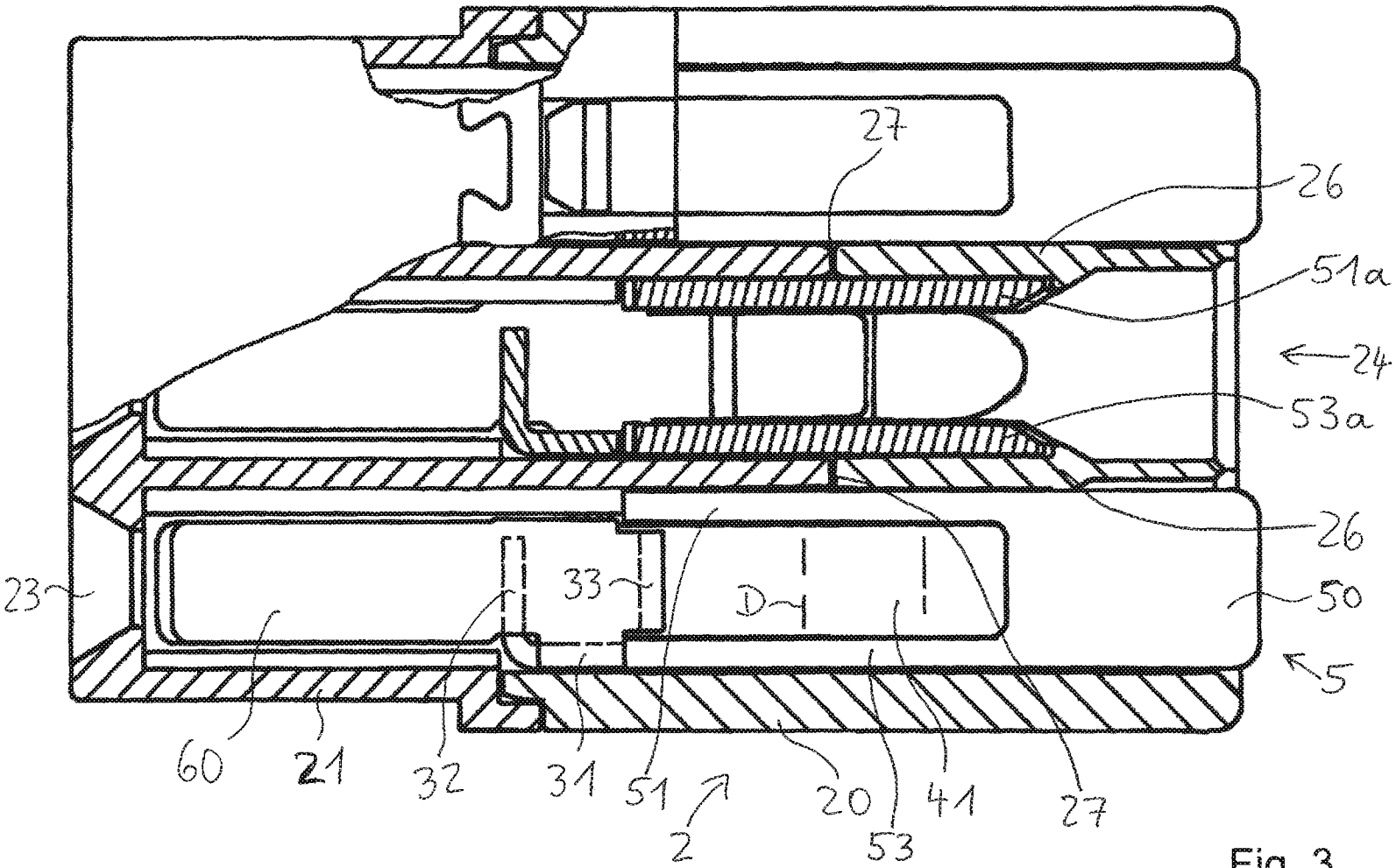
FIG. 3 shows the conductor connection terminal according to FIG. 1 in a plan view and a partially sectioned view of an actuation side.

Actuation element 5 has an actuation handle 50 by means of which actuation element 5 can be operated manually. Two bearing plates 51, 53 are connected to actuation handle 50, of which only bearing plate 51 can be seen in the illustration in FIG. 1. FIGS. 2 and 3 show both bearing plates 51, 53, so that it can be seen that bearing plates 51, 53 are arranged substantially parallel to one another. Bearing plates 51, 53 are designed as flat disk-like elements. Their overall height, i.e., the dimensions of bearing plate 51, 53 in the height direction H, is much greater than the thickness of bearing plate 51, 53, for example, at least 5 times as large or at least 10 times as large or at least 15 times as large.

A follower element 52, which extends between bearing plates 51, 53, is disposed on bearing plates 51, 53. Follower element 52 is used for the mechanical loading and deflection of clamping arm 43. FIG. 1 shows an actuation element 5 in the closed position in the sectional plane. In this closed position of actuation element 5, follower element 52 rests on clamping arm 43 or is at least disposed in the vicinity of clamping arm 43. Follower element 52 connects the two bearing plates 51, 53 to one another. In another embodiment, follower element 52 can also be designed as stub-like formations on the mutually facing inner sides of bearing plates 51, 53, so that follower element 52 is not formed continuous between the two mounting plates 51, 53.

FIG. 1 also shows actuation handle 50*a* of the actuation element of an adjacent spring-loaded clamping connection of the conductor connection terminal; i.e., the conductor connection terminal is designed as a multipole conductor connection terminal in the exemplary embodiment shown. Actuation element of actuation handle 50*a* is pivoted into the open position, so that actuation handle 50*a* is pivoted by a certain angle with respect to the closed position, for example, an angle in the range of 70-90°. In this open position, actuation handle 50*a* protrudes relatively far out of housing 2, wherein the corresponding spring-loaded clamping connection is in the open position. In this open position, clamping arm 43 is deflected upwards by follower element 52, i.e., moved relatively close to contact arm 41. Clamping edge 45 is then clearly distant from clamping section 30, so that an electrical conductor can be inserted into the clamping point or removed from the clamping point without exerting any force.

As can already be seen from FIG. 1, bearing plate 51, 53 has a relatively large dimension in the height direction H as well as in the conductor insertion direction L. FIG. 2 illustrates, both with bearing plates 51, 53 and with bearing plates 51*a*, 53*a* of adjacent actuation element 5, the large extent in the height direction H, which extends at least from the bottom side of conductor insertion opening 22 to the top side of conductor insertion opening 22, and/or extends at least from a position below busbar 3 to a position above clamping spring 4.

It is also clear from FIG. 2 that conductor connection terminal 1 has multiple spring-loaded clamping connections that are adjacent to one another; i.e., the spring-loaded clamping connections are arranged next to one another in the width direction B of conductor connection terminal 1. Housing 2 has a side wall 26, e.g., in the form of an intermediate wall, between adjacent spring-loaded clamping connections.

In the view according to FIG. 3, it becomes clear that side walls 26 each have an abutting edge 27, which is formed by abutting side walls 26 of first housing block 20 and second housing block 21. The abutting edge is advantageously arranged within a region of housing 2 which is overlapped by the adjacent bearing plate 51, 53*a*, 51*a*. In particular, abutting edge 27 can be disposed in the area of the axis of rotation D of the bearing plate or at least at a small distance therefrom. This enables reliable guidance and mounting of the bearing plates as well as large clearance and creepage distances. It can be seen further that only a relatively narrow or thin side wall is necessary between bearing plates 51, 53 of adjacent spring-loaded clamping connections in order to create the necessary clearance and creepage distances.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor connection terminal with at least one spring-loaded clamping connection for connecting an electrical conductor, the conductor connection terminal comprising:

at least one housing with a conductor insertion opening for inserting the electrical conductor to be connected;

a busbar;

a clamping spring with a clamping arm for clamping the electrical conductor to the busbar in a contact area on the busbar; and a pivotable actuation element for actuating the clamping spring, wherein the actuation element has at least one actuation handle for a manual actuation and at least one bearing plate that is connected to the actuation handle and via which the actuation element is rotatably mounted on at least one component of the conductor connection terminal, wherein the actuation handle is accessible from an exterior on an actuation side of the at least one housing, wherein the at least one bearing plate has a circular area and the contact area of the busbar, viewed transversely to a conductor insertion direction, is located within the circular area of the at least one bearing plate, wherein the clamping spring has the clamping arm, a spring bend, and a contact arm, and wherein the contact arm is connected to the clamping arm via the spring bend, and wherein the at least one bearing plate extends in a height direction of the conductor connection terminal at least from a position below a lowermost portion of the busbar to a position above an uppermost portion of the clamping spring or above the contact arm of the clamping spring.

2. The conductor connection terminal according to claim 1, wherein the actuation element is rotatably mounted on the at least one component of the conductor connection terminal via the circular area of the at least one bearing plate.

3. The conductor connection terminal according to claim 1, wherein the at least one bearing plate is rotatably mounted on the at least one housing and/or on the busbar.

4. The conductor connection terminal according to claim 1, wherein the at least one bearing plate includes two bearing plates connected to the at least one actuation handle and via which the actuation element is rotatably mounted on the at least one component of the conductor connection terminal, and wherein the two bearing plates are spaced from one another and are arranged parallel to one another.

5. The conductor connection terminal according to claim 1, wherein the contact arm and the clamping arm run substantially parallel, at least in an area protruding from the spring bend, when the actuation element is in the closed position and no electrical conductor is clamped.

6. The conductor connection terminal according to claim 1, wherein the clamping arm extends from the spring bend, initially predominantly parallel to the actuation side of the at least one housing and, in a further course, obliquely away from the actuation side of the at least one housing.

7. The conductor connection terminal according to claim 1, wherein the at least one bearing plate extends in a height direction of the conductor connection terminal, which extends substantially perpendicular to the actuation side of the at least one housing, at least from a bottom side of the conductor insertion opening to a top side of the conductor insertion opening.

8. The conductor connection terminal according to claim 1, wherein the contact area of the busbar, viewed transversely to the conductor insertion direction, is located entirely within the circular area of the at least one bearing plate.

9. The conductor connection terminal according to claim 1, wherein the at least one bearing plate includes two bearing plates, and wherein the contact area of the busbar is disposed between the circular area of each of the two bearing plates.

10. The conductor connection terminal according to claim 9, wherein the contact arm and the clamping arm are disposed between the circular area of each of the two bearing plates.

11. The conductor connection terminal according to claim 1, wherein the actuation element has a follower that is adapted to move the clamping arm of the clamping spring when the actuation element moves from a closed position to an open position and vice versa.

12. The conductor connection terminal according to claim 11, wherein the follower protrudes laterally from the at least one bearing plate or, when the at least one bearing plates includes two bearing plates, the follower extends from a first one of the two bearing plates to a second one of the two bearing plates.

13. The conductor connection terminal according to claim 11, wherein the follower has a predominantly oval or predominantly kidney-shaped or predominantly elliptical cross-sectional shape.

14. The conductor connection terminal according to claim 1, wherein the at least one housing is designed as a two-part block housing which is made up of a first housing block and a second housing block, and wherein abutting side walls of the first and second housing block abut one another at an abutting edge.

15. The conductor connection terminal according to claim 14, wherein the abutting edge is disposed within a region of the at least one housing, which is overlapped by the at least one bearing plate.

16. The conductor connection terminal according to claim 15, wherein the abutting edge is disposed in an area of an axis of rotation of the at least one bearing plate.

* * * * *